United States Patent [19]

Raskin

[11] Patent Number: 5,025,705

[45] Date of Patent: Jun. 25, 1991

[54] METHOD AND APPARATUS FOR CONTROLLING A KEYBOARD OPERATED DEVICE

[76] Inventor: Jef Raskin, P.O. Box 1638, Pacifica, Calif. 94044

[21] Appl. No.: 441,183

[22] Filed: Nov. 22, 1989

Related U.S. Application Data

[63] Continuation of Ser. No. 295,161, Jan. 6, 1989, abandoned.

[51] Int. Cl.[5] ..... G10H 3/00; G10H 1/34

[52] U.S. Cl. ..... 84/743; 84/453; 84/478; 84/745; 84/DIG. 7

[58] Field of Search ..... 84/453, 462, 477 R, 84/478, 725, 743-745, DIG. 7, DIG. 8; 446/26, 130, 143, 408, 481; 341/22, 32

[56] References Cited

U.S. PATENT DOCUMENTS

| | | | |
|---|---|---|---|
| 3,383,487 | 5/1968 | Wiener | 335/2 X |
| 3,492,905 | 2/1970 | Cameron | 84/464 |
| 3,699,234 | 10/1974 | Adachi | 84/DIG. 7 |
| 3,836,909 | 9/1974 | Cockerel | 84/1.01 X |
| 3,848,252 | 11/1974 | Chang et al. | 341/32 |
| 4,140,039 | 2/1979 | Faulkner | 84/1.03 |
| 4,213,367 | 7/1980 | Moog | 84/1.22 |
| 4,341,141 | 7/1982 | Deutsch et al. | 84/1.24 |
| 4,362,934 | 12/1982 | McLey | 84/DIG. 7 |
| 4,416,178 | 11/1983 | Ishida | 84/1.19 |
| 4,503,745 | 3/1985 | Clark, Jr. et al. | 84/1.1 |
| 4,506,581 | 3/1985 | Sunada | 84/1.1 |
| 4,651,611 | 3/1987 | Deforeit | 84/1.1 |
| 4,699,038 | 10/1987 | Wedge | 84/1.1 |
| 4,700,605 | 10/1987 | Minamitaka | 84/1.24 |
| 4,897,649 | 1/1990 | Stucki | 341/22 |

FOREIGN PATENT DOCUMENTS

| | | | |
|---|---|---|---|
| 3518810 | 11/1986 | Fed. Rep. of Germany | 84/1.01 |
| 2029070 | 3/1980 | United Kingdom | 84/DIG. 8 |
| 8002340 | 10/1980 | World Int. Prop. O. | 446/481 |

*Primary Examiner*—A. T. Grimley
*Assistant Examiner*—Matthew S. Smith
*Attorney, Agent, or Firm*—Townsend and Townsend

[57] ABSTRACT

A method and apparatus for controlling a keyboard operated device having a plurality of keys includes a plurality of sensors associated with each key. Each sensor detects a different one or more attribute of the nature of actuation of the key. Each detected attribute is used by selection circuitry to form a characteristic of the device's response to actuation of the key. The individual characteristics are combined to form a response to actuation of the key. The response may be an output signal or may be further processed internally by the device. In a preferred embodiment the invention is part of a musical synthesizer. One sensor is arranged to detect actuation of a key, while a second sensor is arranged to detect which finger actuates the key. The detection of actuation of a key is used to control the pitch of the resulting output. The detection of which finger actuates the key is used to control the timbre of the resulting output signal. Pitch and timbre are combined by a sound generating device and an audible note or group of notes produced. Other embodiments using the combined characteristics include security systems and computer input devices.

7 Claims, 2 Drawing Sheets

METHOD AND APPARATUS FOR CONTROLLING A KEYBOARD OPERATED DEVICE

This is a continuation of application Ser. No. 07/295,161, filed Jan. 6, 1989 now abandoned.

BACKGROUND OF THE INVENTION

1. Field of the Invention

The present invention relates generally to the field of keyboard operated devices, and more particularly to a method and apparatus for controlling the keyboard device wherein the user actuates keys of the keyboard device with fingers or the like, and wherein the device recognizes which finger or groups of fingers or the like are actuating the keys and issues one or more of a variety of responses as a function of the finger or fingers actuating the keys.

2. Description of the Prior Art

Keyboard operated devices are generally operated by actuating (e.g . depressing) a key with a finger, which causes the device to issue a response, such as a musical note in the case of a musical instrument, transmission of data in the case of a computer, etc. The response is generally preset by hardware remote from the key itself. That is, the nature of the response is generally not controllable by and simultaneously with the actuation of the keys. However, there exist a number of devices which control certain aspects of the output signal based on the depression speed or pressure of a key. For example, the speed with which a key is depressed has been used to control attack, sustain, portamento, glissando, etc. The force with which a key is depressed has been used to control pitch, vibrato, etc.

Furthermore, most keyboard operated devices are incapable of distinguishing between different fingers actuating keys. Thus, they respond independent of which finger actuates the keys. In a musical instrument, for example, the device response to depressing the middle C key with the index finger will be the same as the response to depressing that key with the middle finger. Recognition between fingers has been utilized, however, in one instance to simultaneously generate sound and light images. In that device, the keys are constructed as magnetic heads sensitive to distinctive magnetic fields of magnetic fingertip gloves worn by the user. Keyboard depression is used to control the sound response of the device while the magnetic control affects varying the light images.

For a prior art keyboard controlled device to operate such that each key is capable of producing a different output, each key must be individually defined or programmed. For example, in a music synthesizer one key may output one note with a first timbre, attack, sustain, vibrato, etc. and a second key may output a second note with a second timbre, attack, sustain, vibrato, etc. To achieve this result, the characteristics for each key must be individually established. To change the output characteristics of a key, either the individual key or the entire keyboard must be reprogrammed.

There is a present need in the art for keyboard controlled devices which provide a greater control of the output of the device during operation. The ability to control the characteristics of the output of a device while simultaneously actuating the device provides greater flexibility of the device and is needed in the art. Needed also is the ability to distinguish between different fingers actuating keys of the device so as to provide a greater variety of possible outputs. Finally, a device wherein each key may have a variety of possible outputs without resorting to reprogramming each key is needed.

SUMMARY OF THE INVENTION

The present invention provides a keyboard operated device having the features lacking in the prior art mentioned above. Specifically, the present invention provides a keyboard operated device having a number of keys which are actuated by a users fingers, feet, etc. Each key has associated with it one or more sensors. A first of such sensors is used for detecting actuation of each key. A second of such sensors is used to detect which finger depresses the key. Each sensor produces a response signal. The response signals are combined together to produce an output signal associated with each key. The combined output signal may then be used by any of a wide variety of processing equipment to obtain a variety of results.

In one embodiment, the present invention is part of a music synthesizer. The invention determines which finger (or fingers) are playing a particular note by, for example, detecting differences between magnetic fields of magnets located on the finger tips of the operator. The key pressed determines the pitch of the note played. The dètection of which finger (or fingers) played the note is used to control the timbre of the note played. Each note played has associated with it a particular timbre. Thus, chords or groups of notes may be played having multiple timbres which are controlled by the fingering used to play the notes.

In another embodiment, the present invention is used in a security system. The system includes an access device having a number of keys used to input an access code. The code would be comprised of actuation of certain keys in a certain order using certain fingers. Again, detection of which finger is actuating a key may be accomplished by detecting differences between magnetic fields of magnets located on the finger tips of the operator.

In yet another embodiment, a computer control keyboard operates pursuant to the present invention. The number of available commands could be made to exceed the limit of the number of keys multiplied by the available shift control command alt code or other modifier keys presently imposed in the prior art. There are other factors that render desirable the ability to control the input to a device by detection of which finger operates a key, such as terminals for the disabled.

In yet further embodiments, any of the above described embodiments may be combined with detection of velocity and/or pressure with which a key is actuated to control further aspects of the output. Methods and apparatus for detection of velocity and/or pressure and utilization of such information are well known in the art.

BRIEF DESCRIPTION OF THE DRAWINGS

FIG. 2*b* is a partial schematic diagram of on key of the embodiment shown in FIG. 2*a.

DESCRIPTION OF THE PREFERRED EMBODIMENTS

Figure 1:
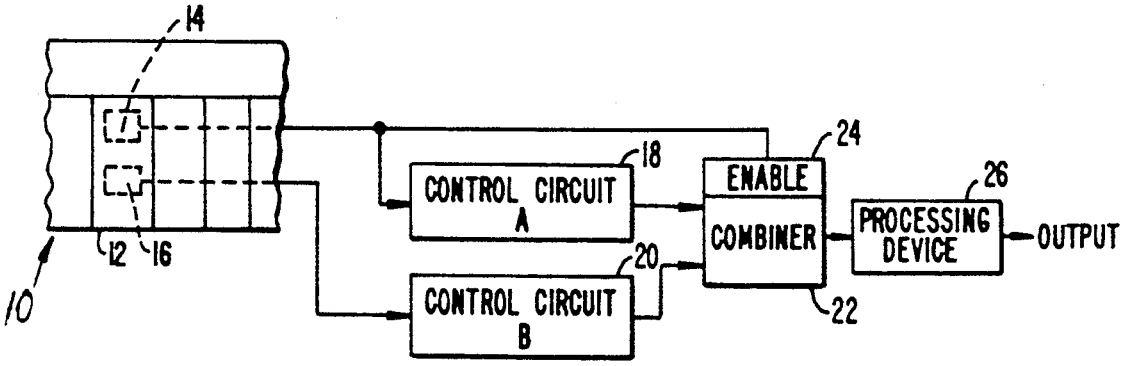
FIG. 1 is a functional block diagram of a typical implementation of the present invention.

Referring to FIG. 1, a typical implementation of the present invention is shown. A keyboard 10 includes keys 12 having a number of sensors 14, 16 associated therewith (the keys and sensors are described more fully below). The output of each sensor is input to a control circuit 18, 20. Each control circuit 18, 20 produces an output signal. These control circuit output signals are combined together by combiner 22. Combiner may be a multiplexer, AND gate, coincidence detection circuit, etc., as appropriate. Combiner 22 may be provided with an enable control 24 controlled by the output of one of the sensors 14. Combiner 22 produces an output signal which is the combination of the control circuit output signals, and which is sent to processing device 26. Enable control 24 acts as a gate controlling the output of combiner 22 to processing device 26. The output signal of processing device 26 may be further processed or may be used to control hardware such as a loudspeaker, lock mechanism, computer peripherals, etc.

Although the present invention finds applicability in a wide variety of environments, the preferred embodiment is in a musical instrument, namely a musical synthesizer. Therefore, the following is a description of a preferred embodiment with the understanding that such description is purely illustrative and in no sense limiting.

Figure 2A:
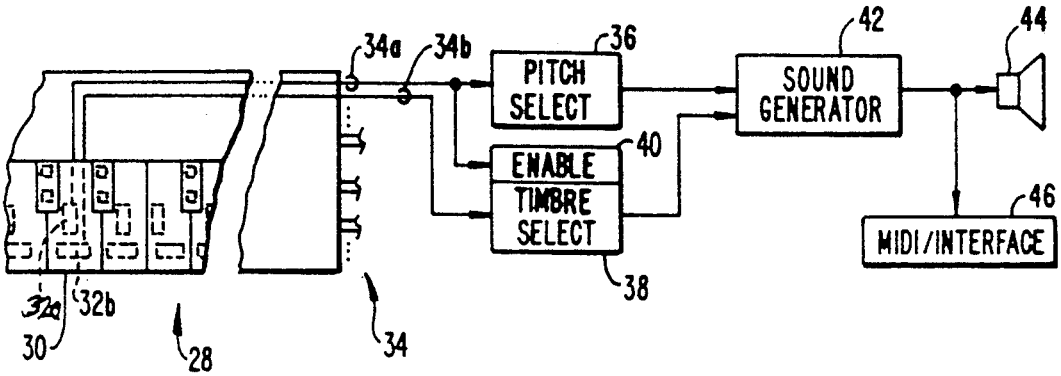
FIG. 2*a* is a functional block diagram of a musical instrument employing a preferred embodiment of the present invention.

FIG. 2*a* shows a musical synthesizer embodying the present invention. A keyboard 28, generally of the type found in prior art synthesizers and pianos, is provided with a number of keys 30 and sensors 32 (including pitch sensor 32*a* and timbre sensor 32*b* shown in FIG. 2*b*). The output signal of keyboard 28 is carried by a number of pairs of output lines 34, each pair comprising a pitch line 34*a* and a timbre line 34*b*. Pitch line 34*a* connects a pitch sensor 32*a* associated with key 30 to a pitch select circuit 36. Similarly timbre line 34*b* connects a timbre sensor 32*b* associated with key 30 to a timbre select circuit 38. Timbre select circuit 38 includes an enable, or gate, section 40. Enable section 40 is connected to pitch sensor 32*a* via pitch line 34*a*. The output signals from each of the pitch select and timbre select circuits 36, 38 are applied to a sound generator 42. The output signals from sound generator 42 are applied to a loudspeaker 44 or similar sound producing means. The output signals from sound generator 42 may also be used to drive other apparatus, for example by way of a MIDI (Musical Instrument Digital Interface) circuit or other interface 46.

Figure 2B:
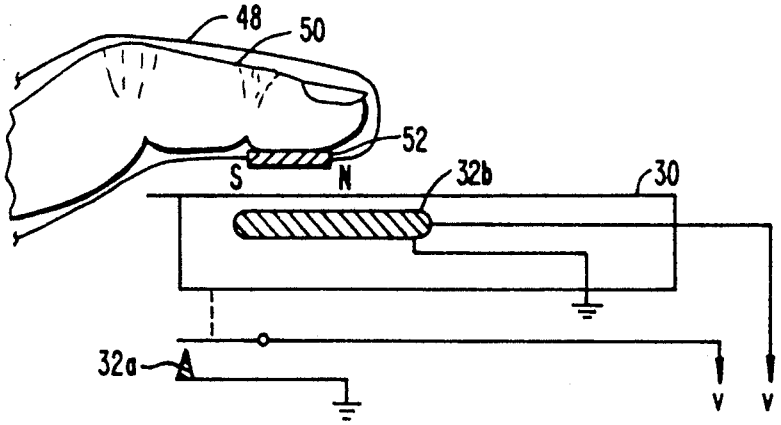

Key 30 and sensors 32*a* and 32*b* are shown in detail in FIG. 2*b*. Sensor 32*a* is preferably a contact switch of the type commonly used in electronic keyboards. One terminal of the contact switch may be connected to ground, the other to a voltage supply so that when connection is made between the two terminals current is caused to flow. Sensor 32*a* may, of course, be of other configurations such as an optical sensor, magnetic pickup or the like. Sensor 32*a* is connected to pitch select circuit 36 (shown in FIG. 2*a*) as part of a matrix such that each such sensor 32*a* is associated with a particular pitch value. In that way, when sensor 32*a* indicates that its associated key is depressed, a particular pitch value for that key issues from the pitch select circuit 36.

Sensor 32*b* is preferably a Hall effect sensor. A Hall effect sensor operates by producing a voltage when a charge is deflected by a transverse magnetic field. The polarity of the voltage produced is an indication of the orientation of the magnetic field. Three states are possible from such sensors: positive voltage (increasing potential), negative voltage (decreasing potential) and no voltage (constant potential). A coil may alternatively be used as sensor 32*b* to detect movement of a magnet and transform that movement into an induced voltage. An appropriate sensor may also be used to determine the relative strength of the magnetic field. This would allow a further degree of control over the output signal since the voltage could be controlled by proximity of the magnet to the sensor.

For sensor 32*b* to be capable of distinguishing between fingers used to depress a key, a magnetic field must be generated around the user's finger tips. A simple method for generating such a magnetic field is shown in FIG. 2*b*. which consists of the user wearing a glove over the entire hand or selected fingers 50. The glove is provided with one or more magnets 52 at its finger tips, oriented to produce a desired magnetic field Alternatively, the magnets may be attached to the finger tips by adhesive, elastic band, or other suitable methods.

Returning to FIG. 2*a*, timbre select circuit 38 receives a signal from sensor 32*b* corresponding to the orientation (and, optionally, magnitude) of the magnetic field of the magnet at the finger tip. Timbre select circuit 38 is programmable such that a particular signal from sensor 32*b* will result in selection of a particular timbre which will be imparted to the selected pitch by sound generator 42. Thus, sound generator 42 may receive pitch information, such as a digital pitch value, from pitch select circuit 36 and timbre information, such as a digital timbre value, from timbre select circuit 38. Sound generator 42 then generates a note or group of notes at the selected pitch with the qualities of the selected timbre, for reproduction, post processing, etc.

In use, the user would put on the glove or gloves having magnets at the finger tips. The keys would then be operated in the manner of prior art musical synthesizers or pianos. When a key is depressed its associated sensor 32*a* indicates to the pitch select circuit 36 the pitch to issue for that key and associated sensor 32*b* indicates the timbre to issue for the finger depressing that key, as discussed above. However, in order to prevent the erroneous issuance of a note which could occur if the sound generator 42 were activated solely by enablement of timbre sensor 32*b* due to mere proximity of a magnet, an enable circuit 40 is associated with and controls timbre select circuit 38. When enable circuit 40 is deactivated no timbre selection signal will be applied to sound generator 42, and consequently no note will issue thereform. The enable circuit 40 is connected to pitch sensor 14 such that when pitch sensor 14 is activated (by depression of its associated key) enable circuit 40 is also enable. In this way, timbre selection has an effect only when it is associated with a pitch selection. In other words, the magnets on the finger tips of the user have an effect only when an associated key is depressed.

In summary, if a key is depressed by a first finger having a magnet oriented such that the magnet has its north pole nearest the finger's tip, a note will issue having the pitch associated with that key and the timbre selected for that magnetic field orientation. If that same key is then depressed by a finger having a magnet oriented such that the magnet has it south pole nearest the finger's tip a note may issue having the same pitch but a different timbre. Likewise, if a key is depressed by a finger having no magnet located at its tip, a note may issue having the selected pitch but with a default timbre.

Figure 3:
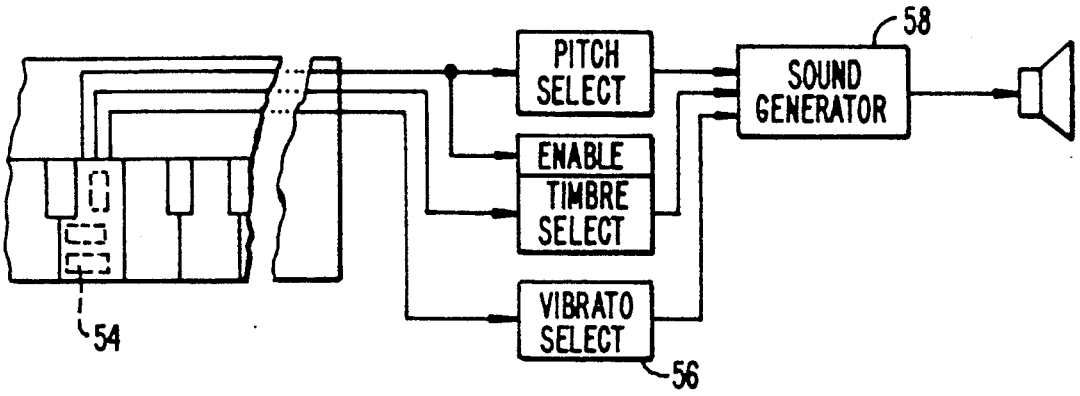
* and FIG. 3 is a functional block diagram of an alternate embodiment of the present invention employed in a musical instrument.

Additional sensors may be provided for each key or groups of keys to increase the control provided over a keyboard operated device. For example, the embodiment of the present invention shown in FIG. 3 includes a third sensor 54 capable of detecting the pressure with which a key is depressed. Sensor 54 sends a signal to a control circuit, such as vibrato select circuit 56, which in turn sends a signal to sound generator 58. In the manner described above, the force with which a key is depressed is converted into a signal which is a proportional indication of the amount of vibrato the note or group of notes that issues from the sound generator 58 will have. Of course, many other characteristics of the note or group of notes produced may be controlled in like fashion, and other attributes of the keystroke, such as speed of depression or release, etc., may be used to control such characteristics.

In alternate embodiments of the present invention, the Hall effect timbre control is replaced with other methods of distinguishing between fingers used to actuate a key. For example, photo-sensors could be placed on the keys capable of color recognition. Color tape, paint or the like may then be applied to the fingers of the user to identify the different fingers. Alternatively, the detector may be a conductive strip which detects conductivity of strips of material placed on the user's finger tips. Or, as another alternative, the sensor is a tuned oscillator and metallic strips are placed on the user's finger tips. When the strips are brought proximate the oscillator, the frequency of oscillation is changed. That change can then be used to identify the finger depressing the key. Furthermore, any of the detection schemes may be used on other portions of the hand or body of the used as the particular application dictates.

In a further embodiment, the invention described above is combined with a "split" keyboard. Many prior art keyboard operated devices are provided with the ability to split up the keyboard into multiple voices. For example, the lower two octaves may be assigned a first voice, while the higher two octaves may be assigned a second voice. By combining the timbre control described above with a "split" keyboard, an increase of two times the available timbral voices over the above described embodiment is possible. Of course, the invention described above is applicable to fields other than musical instruments, and the concept of a the invention together with a "split" keyboard is a equally as broad.

Embodiments of the present invention beyond the scope of musical instruments include security systems used to grant or deny access to a premises, safe or the like, or computer system, telephone system, etc. In such systems, an access device, such as keyboard, may be provided to receive a code which acts as a "key." That code may be comprised of a number of keystrokes entering a number. If that number is discovered, access may be had by others than those intended to have such access. By requiring that the user input the code with certain fingers, the mere discovery of the code will not jeopardize the security of the premises or system. Furthermore, the system may be configured such that a particular glove, ring or the like must be worn to gain entry. In this way, even knowledge of the order of finger strokes is insufficient to allow access. By combining the activation of a key with information about how that key is activated a more versatile and secure security system may be created.

In yet another embodiment the added versatility of a keyboard according to the present invention is employed in a computer input device such as a data input device. Computer input devices are generally arranged like a typewriter keyboard with a number of additional keys. Some of these additional keys, such as the shift, alt, control and command keys, are used as modifier keys to modify the function of other keys. For example, the shift key allows 26 letter keys, each corresponding to a letter of the alphabet, to produce upper and lower case letters. By applying the teachings of the present invention to computer keyboards, the number of functions that keyboard can perform is greatly increased.

In general, to those skilled in the art to which this invention relates, many changes in construction and widely differing embodiments and applications of the present invention will suggest themselves without departing from its spirit and scope. For example, the locations of the sensors and magnets may be reversed such that the user carries the sensors and the magnets are located in the keyboard. Thus, the disclosures and descriptions herein are purely illustrative, and are not intended to be in any sense limiting.

What is claimed is:

1. An apparatus for controlling a keyboard operated device having a plurality of keys which are digitally operated for producing an output signal when one or more of the keys are actuated, comprising:

a set of first sensors, each first sensor being associated with one or said keys, for detecting actuation of each of said first sensor's associated key;

means for producing a first response signal associated with each said key, connected to each said first sensor, which produces a first response signal when actuation of one of said keys is detected by its associated first sensor, said first response signal varying as a function of which key is actuated;

a set of second sensors, each second sensor being associated with one of said keys, for identification of which digit actuates said associated key when said associated key is actuated;

means for producing a second response signal associated with each said key, connected to each of said second sensors, which produces a second response signal which varies as a function of which digit actuates said associated key;

means for combining each said first and second response signals associated with each said key for producing an output signal associated with each key; and means for outputting said output signal associated with each key when said associated key is actuated, wherein said keyboard operated device is a musical synthesizer for producing a plurality of notes and further wherein said second response signal represent a predetermined timbre associated with each digit.

2. The keyboard operated device of claim 1, further including a set of third sensors, each being associated with one of said keys, for detecting the speed of actuation of each of said third sensor's associated key and means for producing a third response signal associated with each said key, connected to each said third sensor, which produces a third response signal which varies as a function of the speed of actuation of the key associated with each said third sensor, and further wherein said means for combining combines said first, second and third response signals.

3. The keyboard operated device of claim 2, further including a set of fourth sensors, each being associated with one of said keys, for detecting the pressure with which each key associated with one of said fourth sensors is actuated and means for producing a fourth response signal associated with each said key, connected to each said fourth sensor, which produces a fourth response signal which varies as a function of the pressure with which each key associated with one of said fourth sensors is actuated, and further wherein said means for combining combines said first, second, third and fourth response signals.

4. A method for controlling a keyboard operated device, comprising the steps of:

actuating one or more keys of the keyboard operated device by actuating means;

detecting which of said keys are activated;

producing a first response signal corresponding to which of said keys are activated;

detecting which actuating means are actuating said keys;

producing a second response signal corresponding to which of said actuating means are actuating said keys;

combining said first and second response signals to form a control signal for controlling the keyboard operated device, the step of locating proximate said actuating means optical identification means associated with each actuating means for identifying each associated with each actuating means for identifying each associated actuating means, and wherein said step of detecting which actuating means are actuating said keys includes detecting which identification means are associated with said actuating means.

5. The method of claim 4, further comprising the steps of:

detecting the speed of actuation of each of said keys;

producing a third response signal corresponding to the speed of actuation of said keys; and combining said first, second and third response signals to form a control signal for controlling the keyboard operated device.

6. The method of claim 5, further comprising the steps of:

detecting the pressure with which each of said keys are actuated;

producing a fourth response signal corresponding to the pressure with which each of said keys are actuated; and combining said first, second, third and fourth response signals to form a control signal for controlling the keyboard operated device

7. The method of claim 4, wherein said keyboard operated device is a musical synthesizer for producing notes, and wherein said first response signal is used to determine pitch of a note and said second response signal is used to determine timbre of said note and said control signal represents said note at said pitch with said timbre.

* * * * *